United States Patent [19]

Loslever

[11] Patent Number: 4,974,540

[45] Date of Patent: Dec. 4, 1990

[54] DEVICE FOR DEFLECTING A HOT STEEL STRIP COVERED WITH A FRAGILE COATING

[75] Inventor: Stéphane Loslever, Maubeuge, France

[73] Assignee: Fabrique De Fer De Maubeuge, Lauvroil, France

[21] Appl. No.: 451,763

[22] Filed: Dec. 18, 1989

[30] Foreign Application Priority Data

Dec. 30, 1988 [FR] France ..... 88 17515

[51] Int. Cl.[5] ..... B05C 13/00; B05C 11/00; B05D 3/00

[52] U.S. Cl. ..... 118/223; 72/46; 72/166; 118/255

[58] Field of Search ..... 118/223, 224, 225, 227, 118/228, 255, 112, 123; 72/46, 166

[56] References Cited

U.S. PATENT DOCUMENTS

| | | | |
|---|---|---|---|
| 2,573,097 | 10/1951 | Epstein | 118/224 |
| 3,072,172 | 1/1963 | Ohnstad | 72/166 |
| 3,093,052 | 6/1963 | Burner et al. | 118/23 |
| 3,576,664 | 4/1971 | Swartz | 427/46 |
| 3,681,121 | 1/1972 | Rizzo | 427/398.3 |
| 3,703,156 | 11/1972 | Niesen et al. | 118/223 |
| 3,742,748 | 7/1973 | Ehm | 72/166 |

FOREIGN PATENT DOCUMENTS 1150183 1/1958 France .

*Primary Examiner*—Jay H. Woo
*Assistant Examiner*—Khanh P. Nguyen
*Attorney, Agent, or Firm*—Griffin, Branigan & Butler

[57] ABSTRACT

A device for deflecting a metal strip (3) running continuously through a treatment line at a location where the temperature of the strip is greater than 100° C., said location being downstream from a station in the line where the strip is covered with a fragile coating. The device has a frame (1), a plurality of strip support members (2) rotatably mounted on the frame about axes extending parallel to the transverse dimension of the strip and distributed around a curve parallel to the desired deflection curve for the strip (3), with each of the members being partially immersed in a tank (4) beneath the member and filled with liquid.

5 Claims, 1 Drawing Sheet

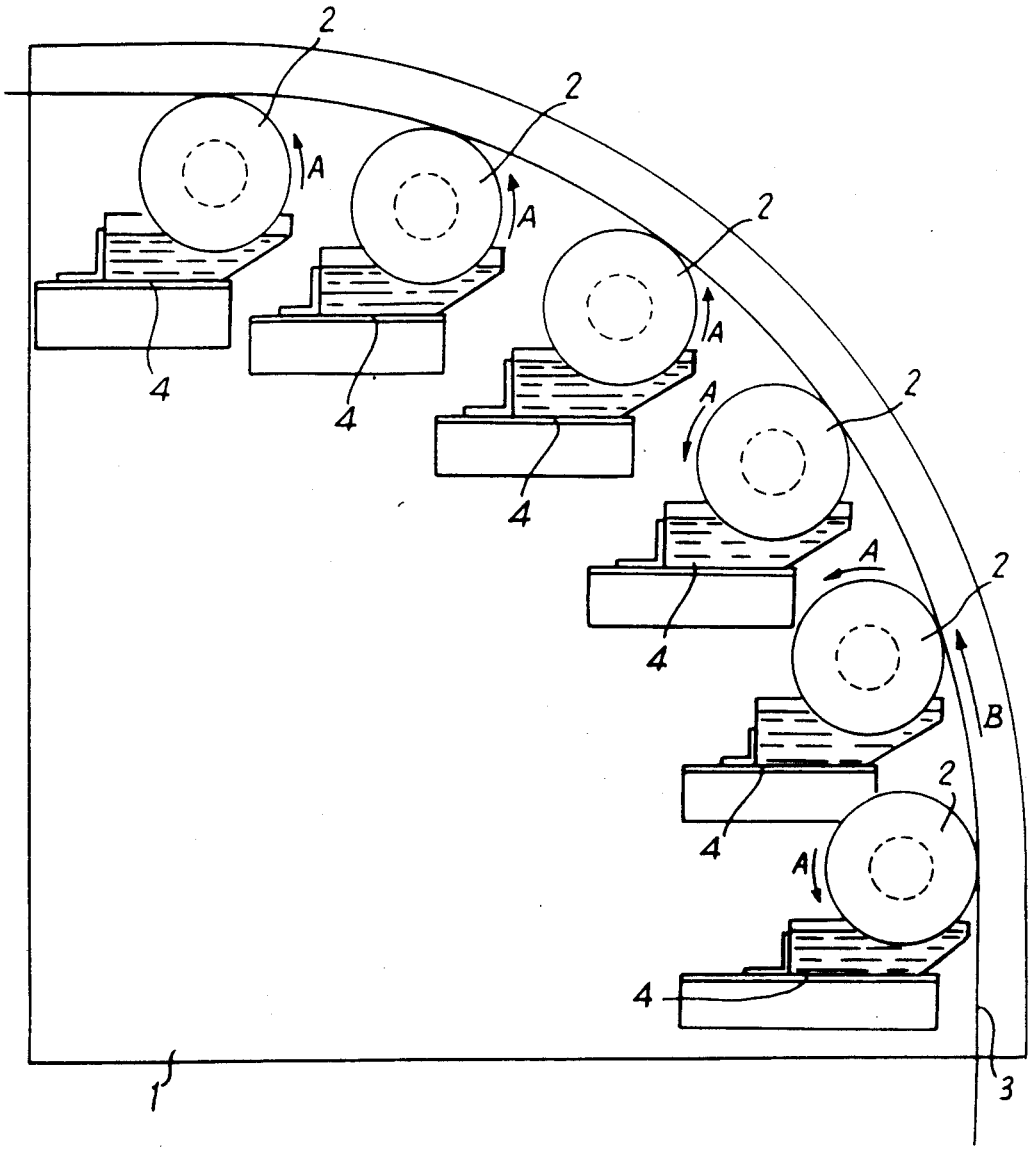
2
2
2
2
2
2
A
A
A
A
A
A
4
4
4
4
4
4
B
1
3

DEVICE FOR DEFLECTING A HOT STEEL STRIP COVERED WITH A FRAGILE COATING

BACKGROUND OF THE INVENTION

Certain lines for treating metal strips include a station for covering the strip continuously with a coating of the varnish type; and on leaving the station, the strip passes through a dryer in which its temperature may be raised to more than 220° C. Downstream from this section of the treatment line, the strip is cooled. The length of strip required for cooling purposes is so long that the strip must follow a path which includes loops, and therefore which includes devices for deflecting the strip. Such deflection is generally provided by a metal roller of sufficiently large diameter and around which the strip is wound through 90° or more. Further devices of this type occur along the path of the strip within the treatment line.

It is observed that on leaving the drying station, the product is ill-suited for bending since the coating is fragile. As the strip winds round a roller the coating flakes off in places, and blisters also occur in places on the coated sheet.

The present invention seeks to remedy these manufacturing defects by providing a deflection device which does not damage the coating on making with contact with the strip.

SUMMARY OF THE INVENTION

To this end, the present invention provides a device for deflecting a metal strip running continuously through a treatment line at a location where the temperature of the strip is greater than 100° C., said location being downstream from a station in the line where the strip is covered with a fragile coating, the device comprises a plurality of strip support members rotatably mounted on a frame about axes extending parallel to the transverse dimension of the strip and distributed around a curve parallel to the desired deflection curve for the strip, with each of the members being partially immersed in a tank beneath the member and filled with liquid.

Preferably, each support member is a cylindrical roller whose length is not less than the width of the coated metal strip. The liquid present in the tanks is water.

BRIEF DESCRIPTION OF THE DRAWING

An embodiment of the invention is described by way of example with reference to the accompanying drawing, in which the sole FIGURE is a diagrammatic side view of the deflector device of the invention.

DETAILED DESCRIPTION

In the FIGURE, a frame 1 is represented merely in the form of side plates, only one of which is visible in the FIGURE. These side plates are carried by the general structure of the treatment line which is not shown. This line may be a line for painting a previously galvanized metal strip, either in the same line or in a separate line. In conventional manner, the paint line or section includes a coating station and downstream therefrom a station for drying the laid-on paint. This drying requires heat to be applied to the strip and this is done either from outside the strip by means of radiation or from inside the strip by induction heating. The advantage of induction heating is that the resulting temperature gradient decreases going outwardly, thereby enabling the outermost layers to be dried last and thus reducing the risks of the paint bubbling. As a result the outermost layers are the least hardened and therefore the most likely to be damaged on engaging deflection members.

The frame 1 supports a plurality of rollers 2 mounted to rotate between the side plates in bearings which are distributed around a curve (in this case a quarter circle) extending parallel to the deflection which is to be imparted to the metal strip 3. The number of rollers used depends on the circumferential length around which strip deflection takes place. This length depends essentially on the thickness of the strip. For example, for common strip thicknesses lying in the range 0.5 mm to 1.5 mm, the quarter circle around the outside of the rollers 2 may have a radius equal to about 650 mm.

Each roller 2 is associated with a tank 4 filled with liquid and carried by the frame, the tank extending beneath the roller so that it is partially immersed therein. As a result, the strip 3 which runs over the rollers 2 causes them to rotate in their bearings with each roller rotating in direction A for strip 3 running in direction B, forming a film of liquid on its outside surface which comes between the roller and the strip, and thus between the surface of the roller and the outside surface of the coating on the strip. This film protects the coating by eliminating direct contact between the coating and the roller providing the film is indeed established between the two bodies and is maintained therebetween. It is recalled that on leaving the paint section, the strip is at a temperature of more than 200° C., which is much higher than the boiling point of water. Nevertheless, the liquid used is water since other liquids (e.g. oil) would suffer from the drawback of dirtying the painted surface which would require additional cleaning treatment. The device of the invention makes it possible to use water since by having a plurality of rollers 2 which are small in diameter relative to the diameter of the curve followed by the strip, the rollers rotate very quickly. This gives rise to energetic cooling because of the high frequency with which each elementary portion of the outside surface of each roller passes through the tank, with the film of water which is formed thereon by entrainment being renewed vigorously. In addition, the small diameter of the rollers relative to the curvature of the strip causes the contact between the strip and the film of water to be limited to a very narrow area running parallel to a generator line, with this contact lasting for a very short period of time, such that the heat passing from the strip to the water is not sufficient to boil off the water completely which would reestablish direct strip-roller contact that is so damaging to the coating. If necessary, the precaution is taken of renewing and cooling the water in the tanks in order to remove the heat coming from the strip.

By way of example, in the embodiment shown the rollers 2 have a diameter equal to one tenth the diameter of curvature of the strip, which means that the rollers rotate ten times faster than would a single roller over which the strip would be wound using the prior art technique. It can be seen that the entrainment of the water by the small rollers is more vigorous and thus the resulting film is more effective.

The invention is not limited to the embodiment described, but extends to variants that do not go beyond its scope. In particular, without going beyond the contents of the invention, the rollers could be replaced by wheels spaced apart along shafts on which they are mounted rotatably in the frame.

I claim:

1. In an apparatus for coating a continuous running length of metal strip with a fragile coating thereon, wherein the apparatus has a coating means for continuously applying a fragile coating to the continuous running metal strip, a drying means for heating the continuous running coated metal strip to a hot temperature of at least 100° C. for drying the coating, and cooling means with deflection means contained therein for deflecting that strip, while being cooled, in a curved configuration, the improvement wherein the deflection means comprises:

(1) a support frame;

(2) a plurality of freely rotatable strip supporting rollers rotatably mounted on said frame such that the rollers lie beneath said strip and the axis of rotation of the rollers extends parallel to a transverse direction of the continuous running coated metal strip for rotatably supporting said strip, and wherein the said rollers are so mounted on said frame so as to define a curved arc path beneath said strip for the supported continuous running strip, which path is substantially parallel to a desired deflection curve of the continuous running metal strip;

(3) tank means disposed beneath said rollers and enclosing a lower portion of the rollers, for containing a liquid, for partially immersing said rollers in said liquid, and for creating a liquid film of said liquid from a supply thereon contained in said tank to said rollers upon rotation of said rollers; and wherein the said rollers are rotatable by contact with the said running strip and the diameter of the rollers in relation to a diameter of said curved path is such that the rollers are so quickly rotatable that heat transferred from said hot metal strip to said liquid film on said rollers is not sufficient to boil off completely said liquid so as to maintain a liquid film between the rollers and a surface of said strip so that there is no direct contact between said coating and said rollers.

2. The apparatus of claim 1 wherein the said rollers are cylindrical and the length of each roller is not less than the transverse dimension of said strip.

3. The apparatus of claim 1 wherein the liquid is water.

4. The apparatus of claim 1 wherein said path has the configuration of a quarter circle.

5. The apparatus of claim 1 wherein the diameter of the rollers is about one tenth the diameter of the said curved path.

* * * * *